US006619602B2

(12) United States Patent
Stevenson

(10) Patent No.: US 6,619,602 B2
(45) Date of Patent: Sep. 16, 2003

(54) GATE SUPPORT SYSTEM

(76) Inventor: James E. Stevenson, 330 Goodrich Rd., Wheatland, WY (US) 82201

( * ) Notice: Subject to any disclaimer, the term of this patent is extended or adjusted under 35 U.S.C. 154(b) by 0 days.

(21) Appl. No.: 10/191,025

(22) Filed: Jul. 8, 2002

(65) Prior Publication Data

US 2003/0038283 A1 Feb. 27, 2003

Related U.S. Application Data

(60) Provisional application No. 60/314,327, filed on Aug. 23, 2001.

(51) Int. Cl.[7] ..... A47B 91/00

(52) U.S. Cl. ..... 248/188.8; 248/410

(58) Field of Search ..... 248/677, 633, 248/188.8, 351, 615, 616, 188.9, 188.5, 188.2, 354.1; 49/49, 190, 396; 403/109.1, 109.2, 109.3, 109.4, 109.5, 109.6, 109.7, 109.8, 337; 256/65.14, 59

(56) References Cited

U.S. PATENT DOCUMENTS

| | | | | | |
|---|---|---|---|---|---|
| 326,695 | A | * | 9/1885 | Wardwell | 474/117 |
| 1,845,143 | A | * | 2/1932 | Friesner | 403/105 |
| 2,051,969 | A | * | 8/1936 | Shastock | 403/105 |
| 2,090,550 | A | * | 8/1937 | Pilbald | 248/410 |
| 3,179,206 | A | * | 4/1965 | Studer | 182/205 |
| 3,615,114 | A | * | 10/1971 | Harris | 292/288 |
| 3,734,441 | A | * | 5/1973 | Lux | 248/354.1 |
| 4,807,720 | A | * | 2/1989 | Kim | 182/205 |
| 5,060,896 | A | * | 10/1991 | Hobbins | 248/188.2 |
| 5,108,066 | A | * | 4/1992 | Lundstrom | 248/410 |
| 5,238,213 | A | * | 8/1993 | Pool | 248/352 |
| 5,595,410 | A | * | 1/1997 | Wilson et al. | 292/306 |
| 6,179,514 | B1 | * | 1/2001 | Cheng | 403/377 |

* cited by examiner

*Primary Examiner*—Korie Chan
*Assistant Examiner*—Kofi Schulterbrandt
(74) *Attorney, Agent, or Firm*—Dean P. Edmundson

(57) ABSTRACT

A gate support system for the free end of a swinging gate. The system can be secured to the free end of an existing gate or it may be included as an integral part of the gate at the time of manufacture. The system includes (a) an elongated support; (b) a foot member carried by the support member and being vertically moveable relative to the support member between raised and lowred positions; (c) bias means for biasing the foot member to the raised position; and (d) a lock for locking the foot member in a desired vertical position relative to the support member. When the gate has been pivoted to a desired position, the foot member can be pushed downwardly until it rests firmly on the ground. The lock will hold the foot member in a lowered position where it will support the weight of the free end of the gate. A trigger can be activated to release the lock and enable the foot member to move to a raised position.

5 Claims, 3 Drawing Sheets

GATE SUPPORT SYSTEM

CROSS-REFERENCE TO RELATED APPLICATION

This application is based upon, and claims the benefit of, my Provisional Application No. 60/314,327, filed Aug. 23, 2001.

FIELD OF THE INVENTION

This invention relates to a support system for the free end of a swinging gate or the like.

BACKGROUND OF THE INVENTION

Swinging gates are commonly used and are pivotally mounted with hinges at one end to a support post or column, etc. The gate is able to swing or pivot relative to the support post or column when the gate is unlatched so as to enable travel of animals or persons through the open gate.

One problem with this type of gate is that all of the weight of the gate is required to be supported on the hinges, at least when the gate is in an open position. This puts a considerable strain on the hinges, particularly when the gate is quite long or is made of a heavy material.

Although it is possible to install a wheel on the free end of the gate to support the free end, the use of a wheel is not always possible or convenient. Also, a wheel does not work well if the free end of the gate is moved through snow or mud. Further, a wheeled support may not hold the gate in a fixed position (e.g. when on a hill or if the wind is blowing against the gate).

There has not heretofore been provided a gate support system having the features and advantages of the present invention.

SUMMARY OF THE PRESENT INVENTION

In accordance with the present invention there is provided a gate support system for the free end of a swinging gate. In one embodiment the support system comprises:

(a) an elongated support member (such as a tube) which can be attached or secured to the free end of a gate;

(b) a foot member carried by the support member and being vertically moveable (and preferably is telescopically received in the support member);

(c) bias means (e.g. a spring) for biasing the foot member to a normally raised position relative to the support member and the free end of the gate; and (d) lock means for locking the foot member in a desired vertical position relative to the support member, whereby the foot member can be moved downwardly until it rests firmly on the ground to support the free end of the gate, and whereby the foot member can be raised away from the ground when the user desires to move the free end of the gate.

The gate support system can be suitably secured to the free end of an existing gate structure, or it may be included in the gate at the time of manufacture of the gate.

When the gate has been pivoted to a desired position, the foot member can be simply pushed downwardly by the user (e.g. by stepping on the foot member and pushing downwardly) until the foot member rests firmly on the ground. The locking means will lock the foot member in a lowered position where the foot member will support the weight of the free end of the gate. This system will also cause the gate to remain in a fixed position (e.g when the wind is blowing against the gate or when the gate is located on a hill). It is not necessary for the gate to be in an open position in order to use the support system. It is possible to lower the foot member to the contact the ground and support the weight of the free end of the gate even when the gate is closed.

When it is desired to raise the foot member, a foot-operated trigger is activated to release the lock and allow the bias means (e.g. a spring) to raise the elongated rod and the foot member to a raised position. Preferably the trigger is moveable between a raised and a lowered position, and preferably there is a spring urging or biasing the trigger to its raised position.

Other advantages and features of the gate support system of the invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
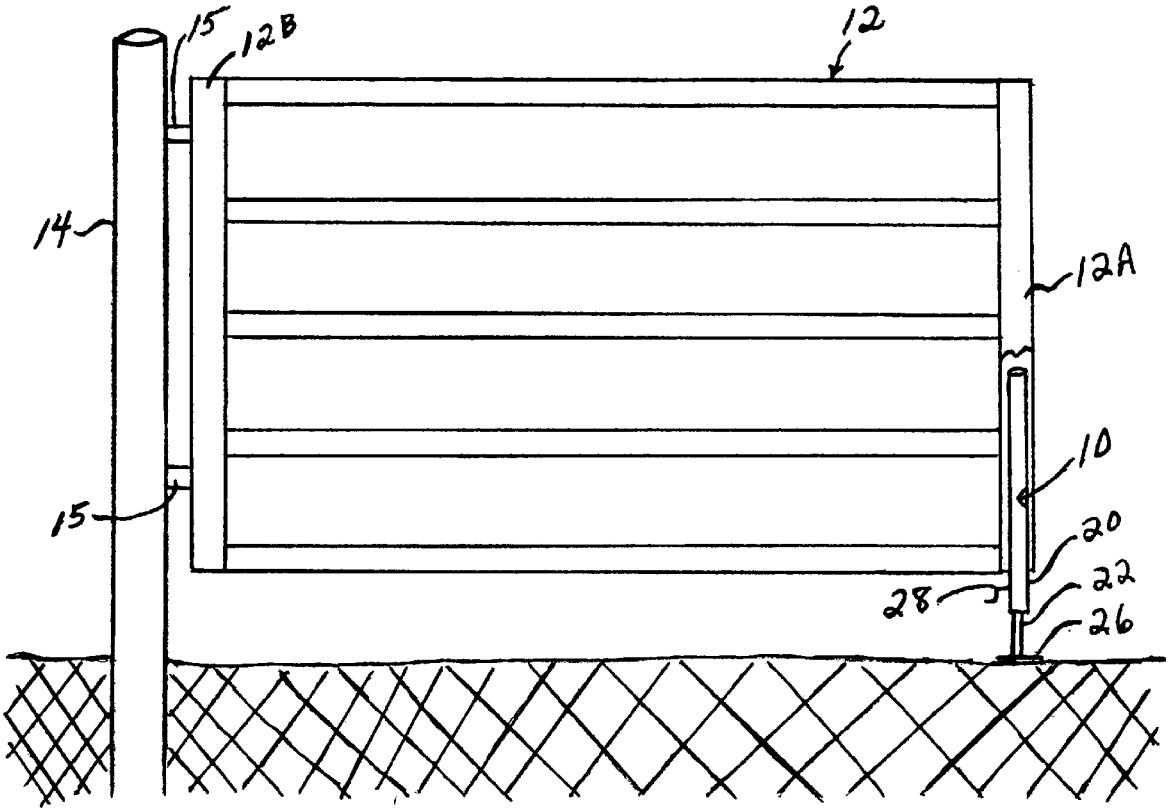
FIG. 1 is an elevational view of a swinging gate which includes the support system of the invention.
Figure 3:
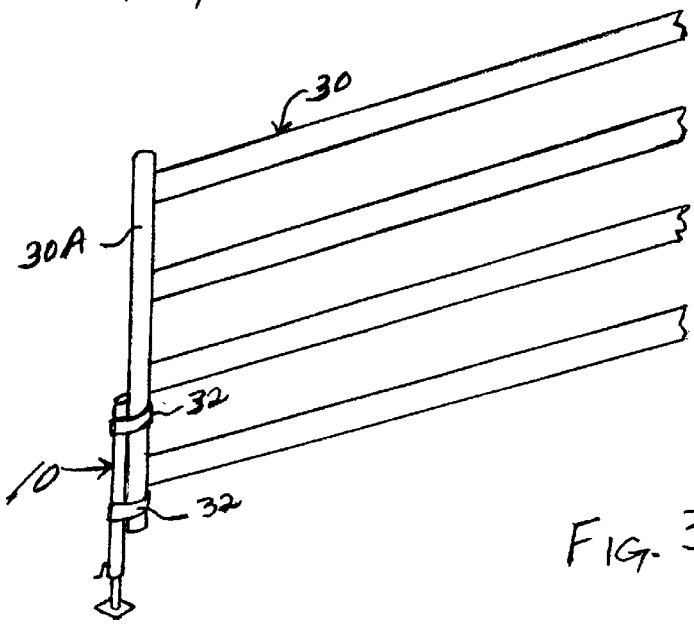
FIG. 3 is a perspective view illustrating another manner in which the gate support system can be secured or attached to the free end of a swinging gate.
Figure 2:
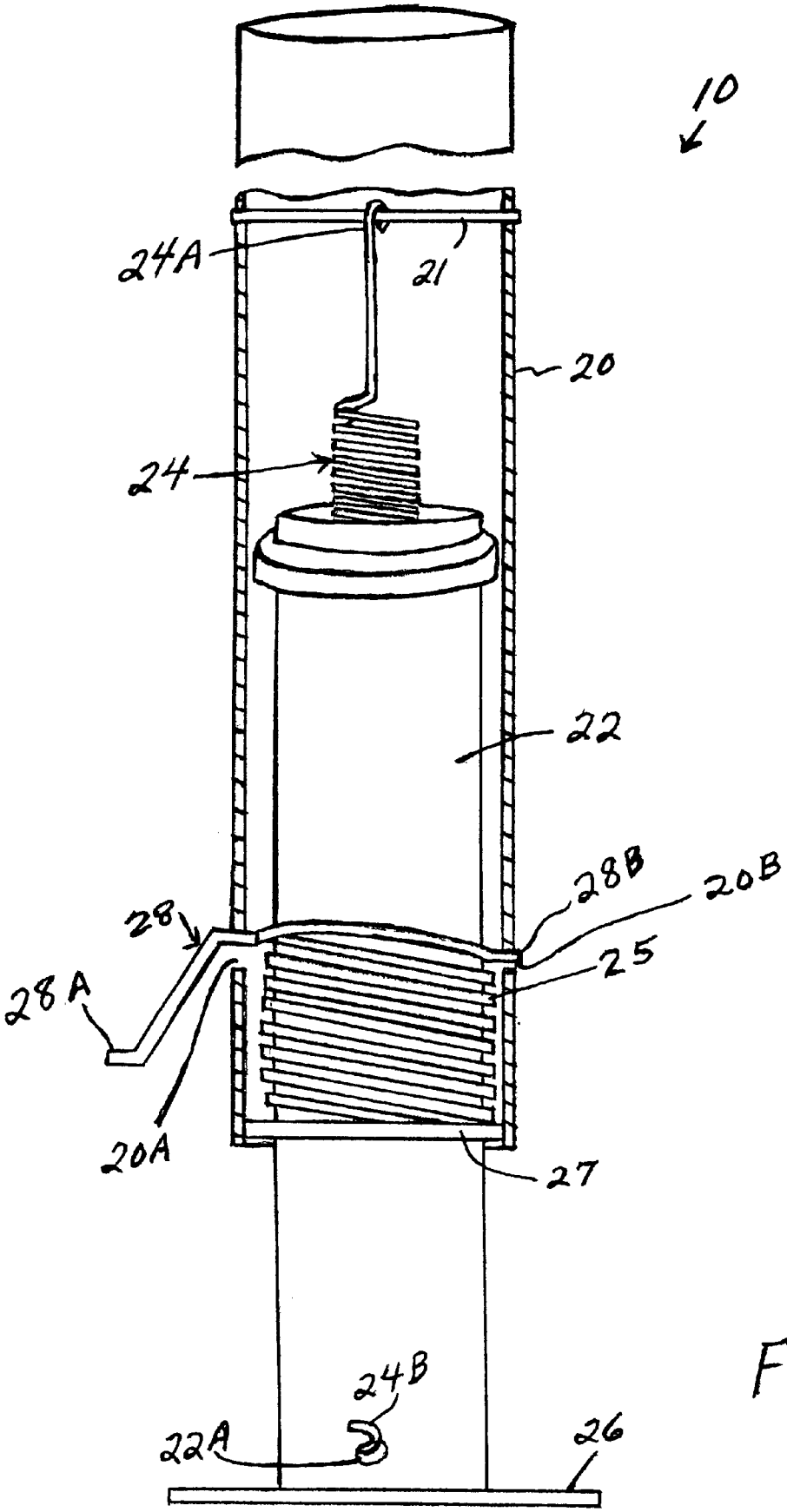
FIG. 2 is an elevational, partially cut-away, view of the support system.
Figure 4:
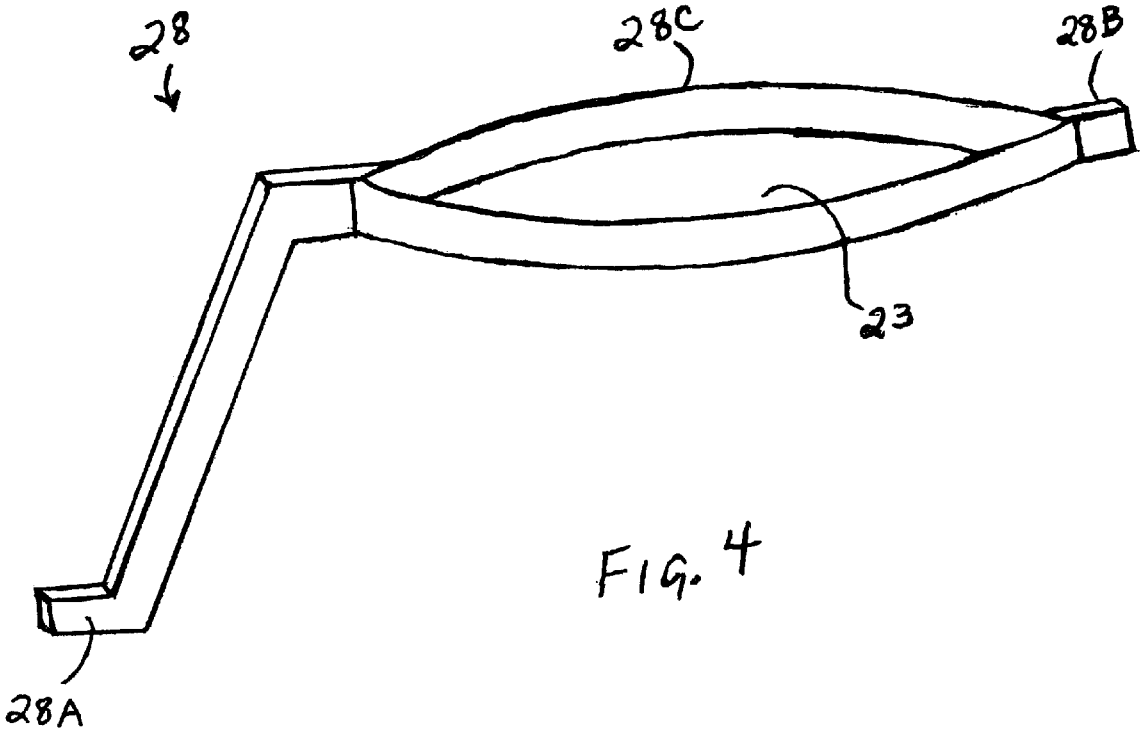
FIG. 4 is a perspective view of one embodiment of a latch or lock for locking the foot in a down position for supporting the weight of the free end of a gate.

In the drawings there is shown a gate 12 of the type which is hinged (by means of hinges 15) at one end 12B to a support post or column 14 such that the free end 12A of the gate is able to be moved between open and closed positions. FIG. 1 is an elevational view of the gate with the support system 10 of this invention incorporated into the free end of the gate (which is shown partially cut away) at the time of manufacture of the gate. FIG. 5 illustrates another manner of attachment of the support system 10 to the free end of a swinging gate, wherein the support system is secured to the free end 30A of gate 30 by means of bands 32.

The support system 10 comprises an elongated support member 20 (which is preferably a tubular member, as shown). The tubular member can be included as an integral part of the gate, as shown in FIG. 1. Within the tubular support member there is an elongated rod (which is preferably a hollow tube 22) having a foot or plate 26 secured to its lower end. Bias means (e.g. a spring 24) inside the elongated support biases the rod 22 and the foot 26 upwardly to a normally raised position. The upper end 24A of the spring is attached to a pin 21 secured near the upper end of the support member 20. The lower end 24B of the spring 24 is secured near the lower end of the rod 22 (e.g. in opening 22A). Because the rod 22 is telescopically received within tubular support 20, the spring 24 draws the rod or tube 22 upwardly inside support member 20 until it is desired to support the free end of the gate.

When the free end of the gate has been pivoted to a desired position, the user can push downwardly on the foot 26 while lifting the free end of the gate slightly until the foot 26 is resting firmly on the ground.

The lock member 28 is preferably in the shape of a ring 28C having a protruding tab 28B on one side and a long finger 28A extending outwardly from the opposite side. The ring 28C defines an opening 23 through which the rod 22 extends. The opening 23 is slightly larger than the outside diameter of the rod 22 so that when the ring 28C is tilted it creates a binding action on rod 22 and prevents rod 22 from moving further upwardly into support member 20. As a result, the rod and foot member support the weight of the free end of the gate and prevent it from sagging downwardly. The foot in firm contact with the ground also prevents the free end of the gate from swinging or moving due to wind, gravity, or other forces. The protruding tab 28B is captured in an opening 20B in a side wall of support member 20, and finger 28A extends outwardly through a slotted opening 20A on the opposite side wall of the support member 20. The tab 28B in opening 20B serves as a pivot point for one side of the ring. Spring 25 surrounds rod 22 and is held in a position between collar or guide 27 and the underside of the ring 28C. The spring urges one side of the ring 28C to a normal raised position where it binds against the rod 22. By pushing downwardly on the outer end 28A of the finger (the trigger member) until the ring is perpendicular relative to the longitudinal axis of the rod 22, the binding action is removed and then the spring 24 is able to pull rod 22 (and foot 26) upwardly relative to the support member 20 and the ground.

Other variants are possible within the scope of this invention.

What is claimed is:

1. A gate support system for use in combination with the free end of a swinging gate, the system comprising:

(a) an elongated support member comprising an elongated tube;

(b) a foot member carried by said support member and being vertically moveable relative to said support member between a normally raised position and a lowered position; wherein said foot member includes an elongated rod which is telescopically received in said elongated tube;

(c) first bias means for biasing said foot member to said normally raised position; and (d) lock means for locking said foot member in a desired vertical position relative to said support member; wherein said lock means comprises (i) a ring member carried by said elongated tube and being moveable between a raised position and a lowered position, wherein when said ring member is in said raised position it engages said elongated rod, and when said ring member is in said lowered position it disengages said elongated rod; and (ii) a second bia means being spring member for biasing said ring member to said raised position.

2. A gate support system in accordance with claim 1, wherein said first bias means comprises a spring secured between said elongated rod and said elongated tube.

3. A gate support system in accordance with claim 1, wherein said ring member further comprises a trigger member moveable between raised and lowered positions, wherein said elongated tube includes a side opening through which said trigger member protrudes; and wherein when said trigger is moved from said raised position to said lowered position, said ring member disengages said elongated rod.

4. A gate support system for use in combination with the free end of a swinging gate, the system comprising:

(a) an elongated support member comprising an elongated tube;

(b) a foot member comprising an elongated rod which is telescopically received in said elongated tube and is moveable between a normally raised position and a lowered position;

(c) bias means comprising a first spring for biasing said foot member to said normally raised position;

(d) a ring member carried by said elongated tube and being moveable between (i) a raised position, where said ring member engages said elongated rod, and (ii) a lowered position, where said ring member disengages said elongated rod; and (e) a second spring member for biasing said ring member to said raised position.

5. A gate support system in accordance with claim 4, wherein said ring member further comprises a trigger member, moveable between raised and lowered positions, wherein said elongated tube includes a side opening through which said trigger member protrudes; and wherein when said trigger member is moved from said raised position to said lowered position, said ring member disengages said elongated rod.

* * * * *